US007398661B2

(12) United States Patent
Rizzetto

(10) Patent No.: US 7,398,661 B2
(45) Date of Patent: Jul. 15, 2008

(54) CLOTHES WASHING MACHINE WITH IMPROVED WATER DISPENSERS

(75) Inventor: Pietro Rizzetto, S. Stino di Livenza (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 482 days.

(21) Appl. No.: 11/105,718

(22) Filed: Apr. 14, 2005

(65) Prior Publication Data

US 2005/0262881 A1 Dec. 1, 2005

(30) Foreign Application Priority Data

May 25, 2004 (EP) ..... 04102279

(51) Int. Cl.
*D06F 39/08* (2006.01)

(52) U.S. Cl. ..... 68/17 R; 68/207

(58) Field of Classification Search ..... 68/17 R, 68/207

See application file for complete search history.

(56) References Cited

U.S. PATENT DOCUMENTS 3,044,285 A * 7/1962 Koplin ..... 68/12.18
3,086,379 A * 4/1963 Plante ..... 68/12.13
3,747,645 A * 7/1973 Holster et al. ..... 137/838
3,949,576 A * 4/1976 Waugh et al. ..... 68/12.18
4,043,158 A * 8/1977 Bochan ..... 68/17 R
4,111,011 A * 9/1978 Waugh ..... 68/17 R
4,905,485 A * 3/1990 Fornasari ..... 68/12.11
4,960,139 A * 10/1990 Rizzetto ..... 137/625.46
5,884,506 A * 3/1999 Blauert et al. ..... 68/17 R

FOREIGN PATENT DOCUMENTS

EP 0 719 884 7/1996
EP 04102080.1 5/2004
IT PN2003A000034 5/2003

OTHER PUBLICATIONS

European Patent Office 0/15256 Aug. 1984.*

* cited by examiner

*Primary Examiner*—Frankie L Stinson
(74) *Attorney, Agent, or Firm*—Pearne & Gordon LLP

(57) ABSTRACT

Clothes washing machine comprising: a common water-distribution manifold, a plurality of electromagnetic valves provided downstream of said water-distribution manifold and connected on respective outlet conduits, a plurality of chambers supplied via a respective one of said outlet conduits, a further chamber supplied with a water flow generated by the intersection of said outlet conduits, wherein a nozzle lodged in a bellows is supplied with a water flow a fully separated fifth conduit having a respective air-gap and starting from one of said valves; the initial portions of said outlet conduits, upstream the air-gaps, are a single en bloc body, which is realized in a single item together with the assembly of the water flat conveyors downstream the air-gaps.

5 Claims, 5 Drawing Sheets

CLOTHES WASHING MACHINE WITH IMPROVED WATER DISPENSERS

Figure 1:
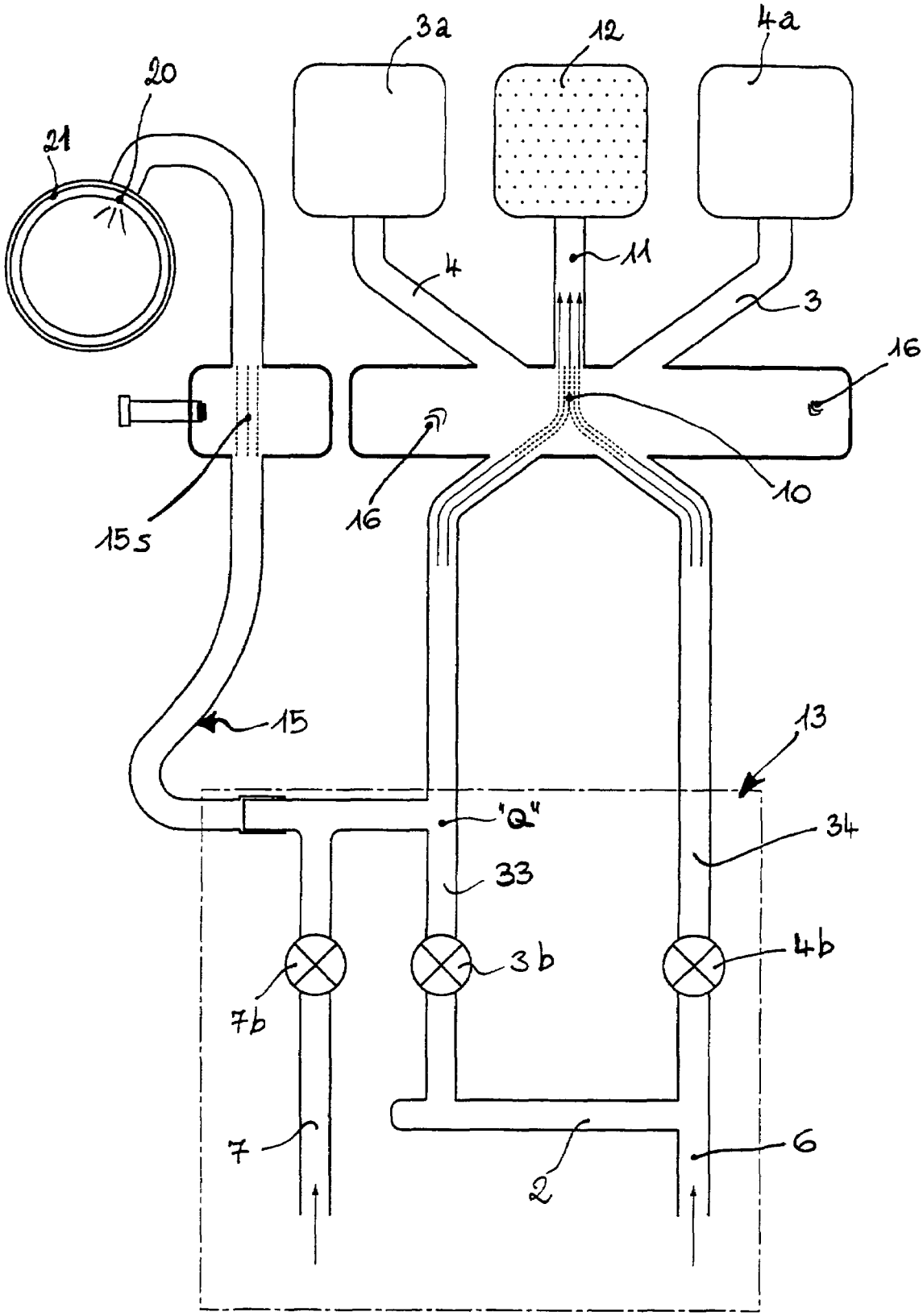

The instant invention refers to a kind of clothes washing machine, preferably of the type for use in households, able of working in an improved and more advantageous manner as far as control of the water flows being let into the machine is concerned, and particularly is provided with an additional water flow coming from the bellows and directed with appreciable energy towards the inner portion of the laundry contained into the tub.

Although reference to a regular, simple-type clothes washing machine will be made throughout the following description, it shall be appreciated that what is set forth below may similarly be applied to and, therefore, be suitable for combined clothes washing and drying machines.

Clothes washing machines are known in the art, which operate by using not only the home water delivery system, which usually delivers cold water, but also an additional water delivery system specially provided in the home to supply hot water. Quite popular in the US market, in particular, is a kind of clothes washing machine for residential use, and even for use in such communities as apartment buildings, boarding schools, colleges and the like, which are not provided with a heating element of their own to autonomously heat up the water flowing in from the public water utility system and used for washing, but are on the contrary arranged to directly take in and use the hot water delivered by said additional hot-water supply system.

This construction and circuit configuration of the above-described arrangement has turned out as being particularly easy to implement, as well as reliable in its operation. However, it is rather expensive owing to both the presence of as many as five distinct electromagnetic valves, each one of which must be connected independently. All this eventually translates into a rather high overall final cost of the water supply and distribution assembly, which turns out as being by all means undesired in the particular case of a kind of appliance such as a clothes washing machine, which is generally required to be as low and effective in costs as possible.

In order to overcome this drawback, from the European Patent Application EP 04102080.1 an arrangement of a clothes washing machine is known, with a drum, a bellows, a common water-distribution manifold, a plurality of electromagnetic valves arranged downstream of said water-distribution manifold, and connected to a respective inlet side thereof to said common water-distribution manifold, a plurality of outlet conduits provided at the delivery ports of respective ones of said electromagnetic valves, a respective plurality of chambers provided to contain washing products, rinsing aids and similar substances, each one of said chambers being supplied via a respective one of said outlet conduits, a (cold-) water inlet conduit directly connecting the low-temperature water supply system to said water-distribution manifold, a (hot-) water inlet conduit connecting the high-temperature water supply system to a pre-determined one of said outlet conduits downstream of the respective electromagnetic valve a further electromagnetic valve installed in said (hot-) water inlet conduit upstream of the point at which the latter connects with said pre-determined outlet conduit, a further chamber that is supplied with a respective water flow coming from a fourth outlet conduit and generated by the intersection and physical impinging between the two water-flows in said two outlet conduits; in said washing machine said bellows comprises nozzle means to direct a jet of water coming from a fifth conduit derived from a point in one of said outlet conduits, downstream the connection with said third conduit, but upstream said intersection between said outlet conduits, said fifth conduit being supplied with a respective air-gap.

The initial portions of said outlet conduits and of said fifth conduit are a single en bloc body, which delimits, on the same side, both the two water flows in the respective outlet conduits before said intersection, and said air-gap of said fifth conduit.

Even quite simple and inexpensive, this arrangement shows the problem that said fifth channel 15, being derived from one of said outlet channels downstream the respective electro-valve and a few centimetres far from it, generates an unavoidable pressure loss into it, and then a worsening of its ability of removing the substances for the washing contained in the chambers placed under the flat conveyer to which said channel is bound.

A further drawback of such implementation is due to the fact that a possible temperature sensor, placed in the portion of the intermediate conduit between said fifth conduit and downstream of the conjunction of the hot water conduit to the corresponding cold water conduit, may detect in an unstable way the water temperature flowing in said conduit portion, because in that point the mixing of the hot water with the cold water may have been not fully completed.

From EP 0719884B1 it is known to make up a branch-duct for a water flow directed, downstream the air-gap, towards other operating devices of the machine; however such a solution is not effective from the operating point of view as said duct branches out exactly from a portion of the water dispenser that usually is placed over the chambers containing the products for use in the washing process; the consequent pressure loss that is transferred also to the water flow inside said branch is so remarkable to compromise a proper mass-flow of the water jet coming from the bellows and that has to penetrate into the laundry load.

It would therefore be desirable, and it is actually a main object of the present invention, to provide a clothes washing machine adapted to be supplied with both cold and hot water and provided with arrangements that are capable of distributing the individual flows of said hot and cold water to flow into the various chambers containing the washing and rinsing aids according to an optimised use of the electrovalves, provided with a branch duct directing the respective water flow with a proper pressure to a nozzle lodged into the bellows, and provided with means able to detect the actual temperature in said branch duct after the complete mixing of the respective water flow, and wherein the water dispensers, the relevant air-gaps and the intersection of the water flows are made in a simply and easy way and at a significantly low level costs, According to the present invention, this aim is reached, along with further ones that will be apparent from the following description, in a clothes washing machine incorporating the features as recited in the appended claims.

Figure 2:
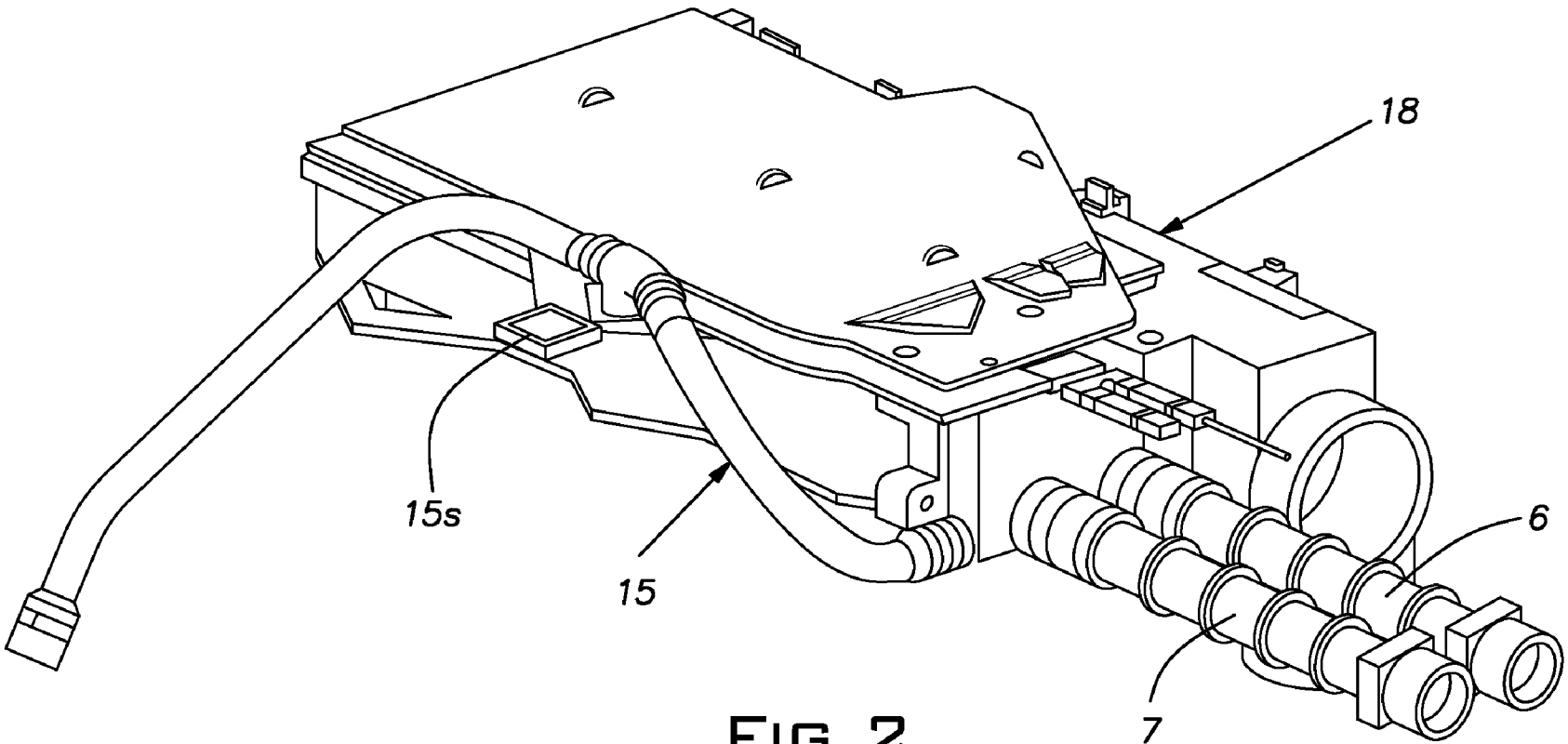
Figure 3:
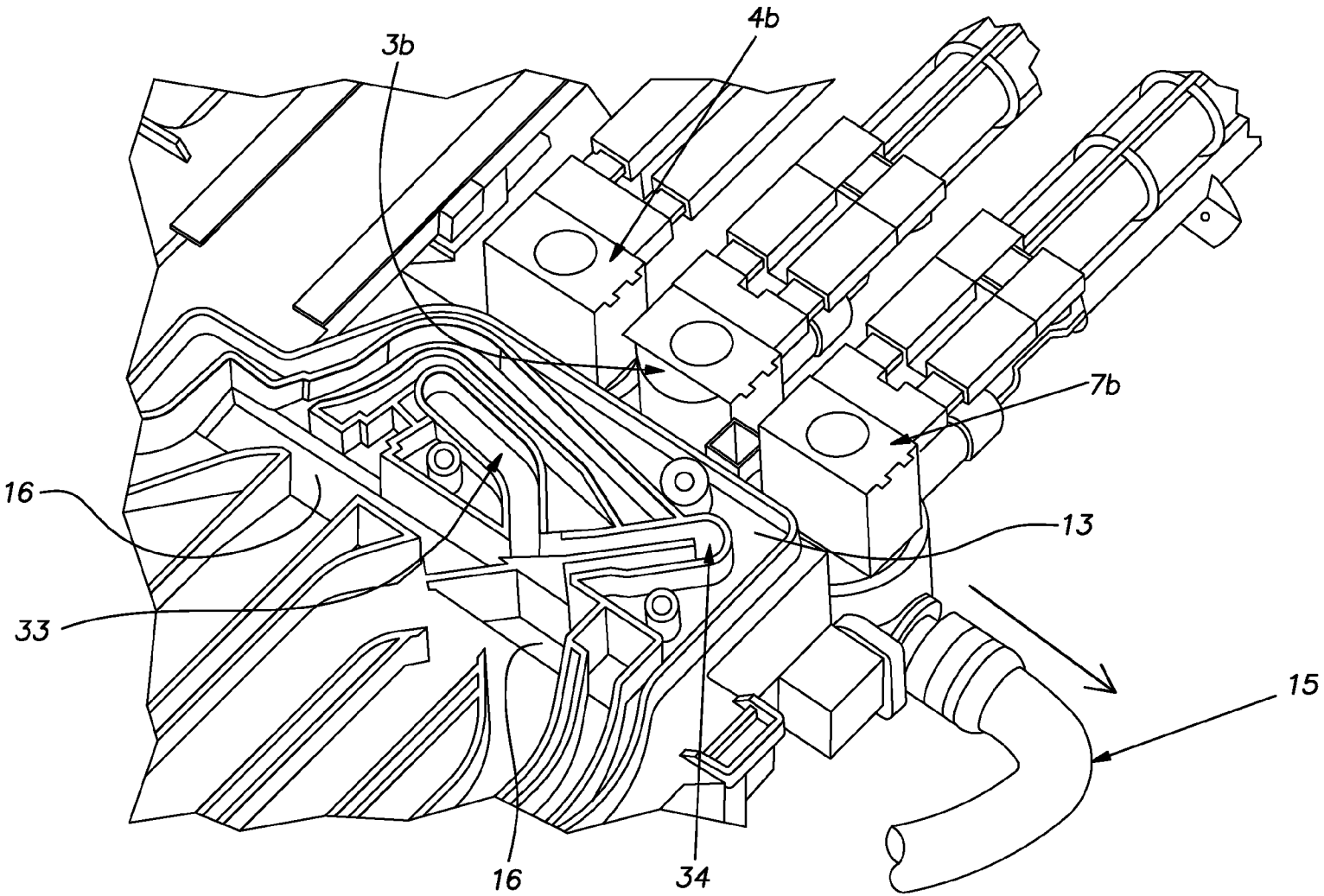
Figure 4:
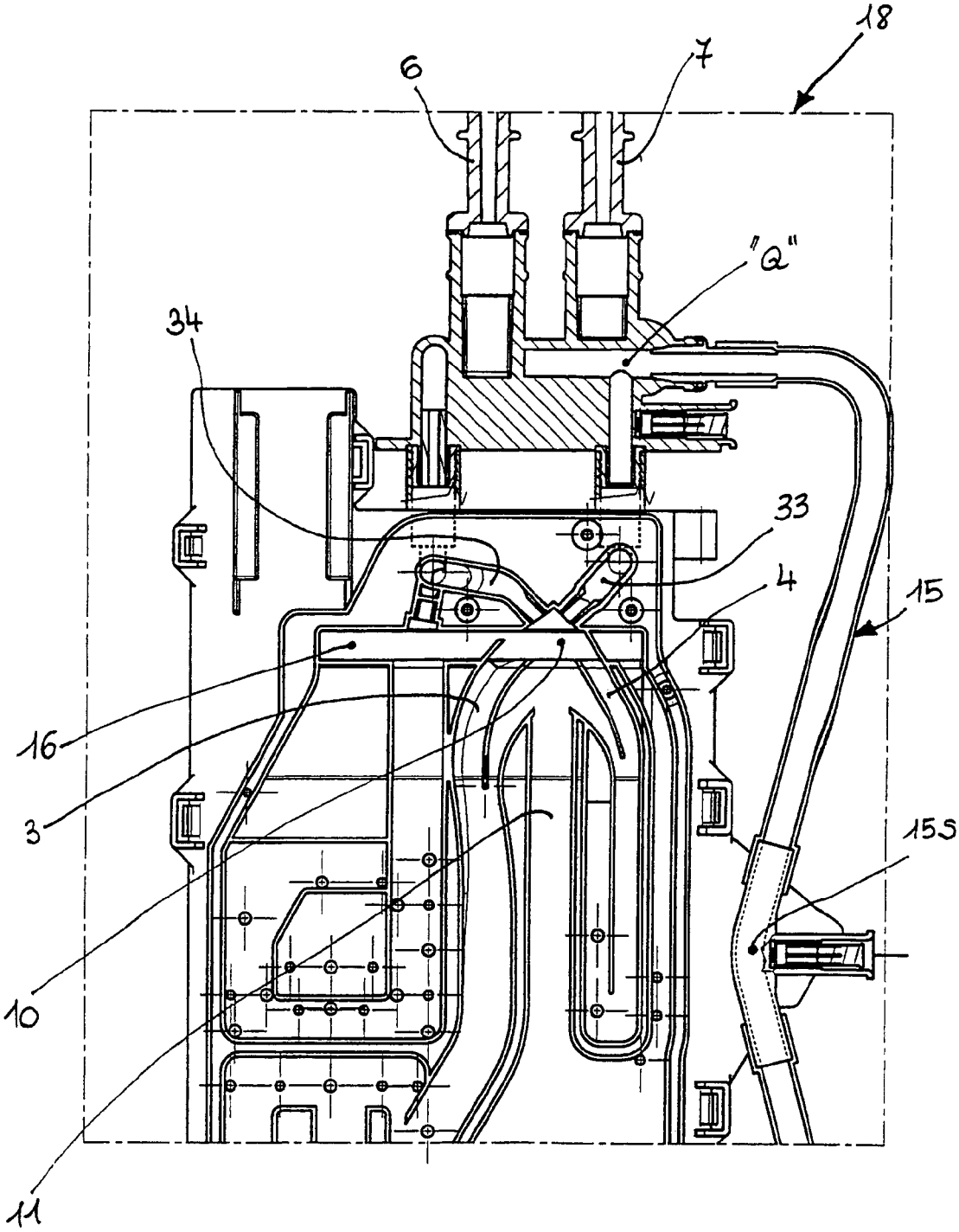
Figure 5:
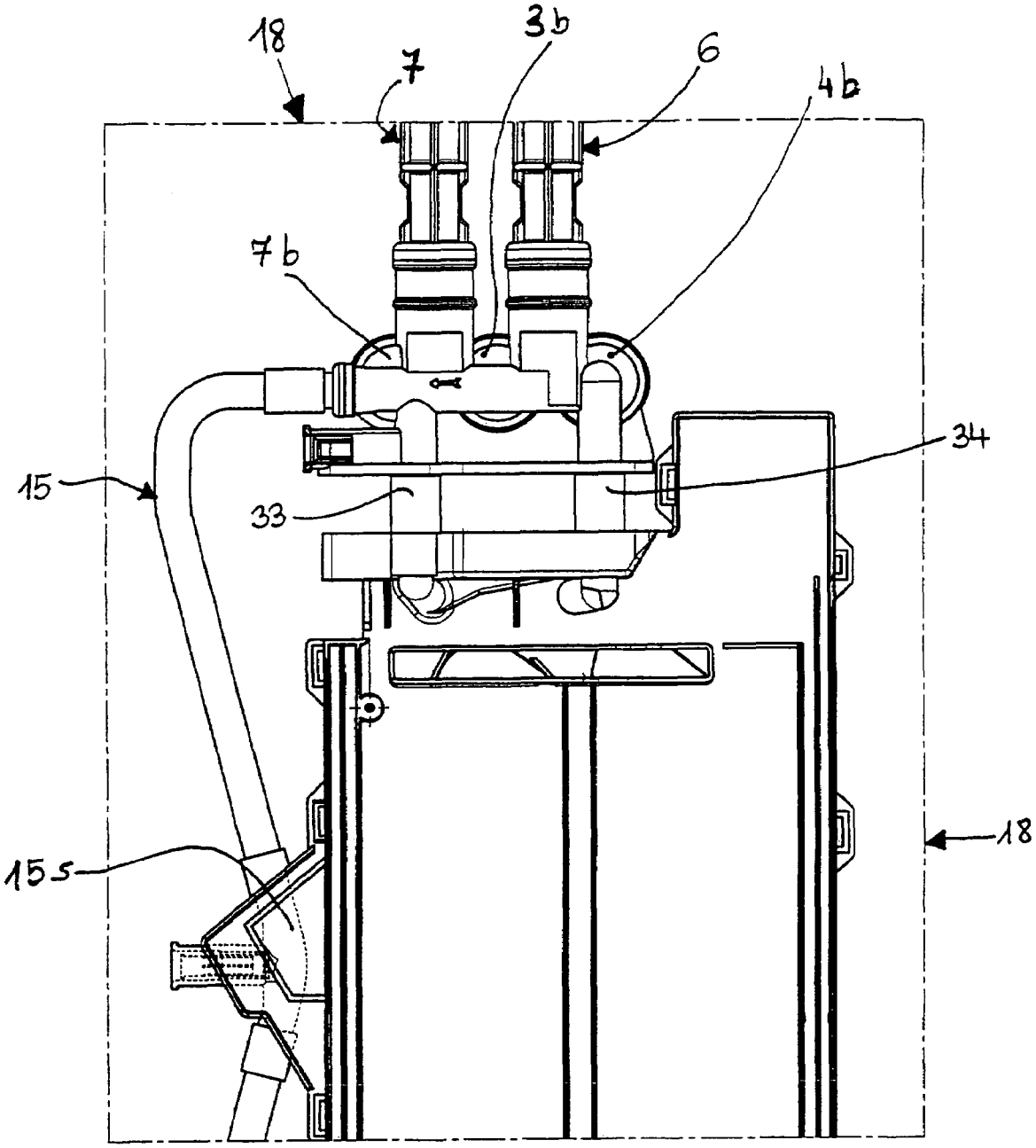

Anyway, features and advantages of the present invention will be more readily understood from the description that is given below by way of non-limiting example with reference to the accompanying drawings, in which:

FIG. 1 is a general symbolical, schematic view of a water supply control means in a washing machine according to the present invention;

FIG. 2 is a perspective view of a preferred embodiment of the water supply control means according to the present invention, FIG. 3 is an enlargement of a portion of a water supply control means illustrated in FIG. 2, FIG. 4 is a symbolic section view of the water supply control means of FIG. 2, from a section plane parallel to the conveyor and cutting the hot- and cold-water mains pipes, FIG. 5 is planar view of the water supply control means of FIG. 4, seen from the bottom.

With reference to FIGS. 1 and 2, in a clothes washing machine according to the present invention there is provided a drum adapted to hold the clothes to be washed, not shown, a common water distribution manifold 2, connected to a mains pipe 6, a plurality of outlet conduits 3, 4, leading into two chambers 3*a*, 4*a*, which contain products for use in the washing process and all other processes associated therewith, said outlet conduits comprising two respective electromagnetic valves 3*b*, 4*b*, that are adapted to control the flow of water from said common water distribution manifold 2 to each one of said respective outlet conduits 3, 4.

At this point it has to be strongly stressed that the invention applies to water dispensers also wherein further electrovalves are placed, which control respective water flows into respective chambers, as generally described in the cited Italian Patent Appl. No. PN2003A 000034; however for the sake of simplicity the instant description refers to the type of water dispenser provided with only two outlet conduits, controlled by respective electrovalves, that intersect in a specified point to create a further outlet conduit supplying a respective chamber, and a third outlet conduit 7, normally used to admit the hot water only, controlled by a respective electrovalve 7*b*, and that leads into one of said outlet conduits 3 or 4.

According to the invention, said two outlet conduits 3 and 4 do come directly from the respective electrovalves and are oriented to a common intersection point 10, wherein obviously their physical continuity will end to allow the respective water flows to impinge each other, and consequently to form a new water flow that enters into a fourth outlet conduit 11 bound to a respective chamber 12.

Said intersection and interruption point of the outlet conduits 3 and 4 is used also as the air-gap of the same two conduits 3 and 4, and so their air-gaps will coincide with the air-gap of said fourth conduit 11, obviously generated only downstream the same intersection 10.

So a complete coincidence is implemented between the air-gaps of the three outlet conduits 3, 4 and 11 and the intersection point 10 of two of them.

From a physical point of view such coincidence is implemented through a single body 13 that in the same time:

contains the portions 33 and 34 of said two conduits 3 and 4 upstream the respective air-gaps, delimits said air-gaps on the electrovalves side, and realises a supporting element of said electrovalves 3*b*, 4*b* and 7*b*, or of said manifold 2 bearing said valves, wherefrom said outlet conduits 3 and 4 are leaving.

Only for example, said structure has been described in the cited It. Pat. Application, as a "common distribution manifold 2".

According to a further advantageous aspect of the invention, said single body 13 is delimited by a "trench" 16 which works both as an air-gap and related intersection point for said two outlet conduits 3 and 4.

According to a main aspect of the invention, a fifth outlet conduit 15 branches out from a point "Q" placed just downstream said valve 3*b* and goes out singly from said en bloc 13, as showed symbolically in FIG. 1; going out from said en bloc 13, said fifth conduit 15 keeps up as a single pipe, preferably as a flexible pipe well visible in FIG. 2, that matches exactly with said nozzle 20 of said bellows 21.

It will be now apparent that said conduit 15, branching out exactly from the valve 3*b*, does not involve in any manner the conduit 3 and then does not modifies the relevant water flow pressure.

Inside said conduit 15, and at some distance from said en bloc 13, a respective air-gap is given, which can be made in a well conventional way and therefore it is not showed.

Advantageous into said air-gap a proper temperature sensor may be lodged; the fact that said air-gap is positioned at a certain distance from the manifold 2 and from the electrovalves will assure that in the fifth conduit 15 the water is immediately mixed before of arriving to said air-gap 15S; therefore the temperature sensor there placed measures in a truly and stable way the temperature of the flowing water.

According to the prior art, the chambers containing the substances to be used in the washing process, are provided with respective water flows raining down from respective flat conveyers made en bloc and that comprise a common bottom surface, duly provided with holes to let the water down, and delimiting downwards the plurality of channels placed above said chambers.

As a last improvement, and considered that:

said flat conveyers are made as an integrated en bloc, said single body 13 is also made en bloc, and said trench 16, working as an air-gap both for these conduits 3 and 4, is a separation means between said single body 13 and said flat conveyer, it comes out that, from a productive point of view, it is much more effective and convenient to realise both said flat conveyer and said single body 13 as a fully integrated en bloc 18, wherein said trench 16 is made up with a simple and empty separation portion between the two facing portions of said fully integrated en bloc 18.

From a productive point of view said fully integrated en bloc 18 can be made by a single injection moulded item, to which the valve assembly and said common distribution manifold 2 are then associated.

According to a preferred embodiment of the present invention, a cold- water inlet conduit 6 is provided to debouch into said common water distribution manifold 2.

The invention claimed is:

1. Clothes washing machine comprising:

a drum for holding the clothes to be washed, a bellows (21), a common water-distribution manifold (2), a plurality of electromagnetic valves (3*b*, 4*b*) arranged downstream of said water-distubuton manifold and connected on a respective inlet side thereof to said common water-distribution manifold (2), a plurality of outlet conduits (3, 4) provided to respective ones of said electromagnetic valves, a respective plurality of chambers (3*a*, 4*a*) provided to contain washing products, rinsing aids and similar substances, each one of said chambers being supplied via a respective one of said outlet conduits (3, 4), a cold-water inlet conduit (6) directly connecting a low temperature water supply system to said water-distribution manifold (2), a hot-water inlet conduit (7) connecting a high-temperature water supply system to a pre-determined one (3) of said plurality of outlet conduits downstream of the respective electromagnetic valve (3*b*), a further electromagnetic valve (7*b*) installed in said hot-water inlet conduit (7) upstream of the point at which the latter connects with said pre-determined outlet conduit (3), a further chamber (12) that is supplied with a respective water flow directed from a fourth outlet conduit (11) and generated by the intersection (10) and physical impinging between a plurality of water-flows directed from respective initial portions (33, 44) of said plurality of outlet conduits (3, 4), wherein;

the initial portions (33, 34) of said plurality of outlet conduits (3, 4) are a single en bloc body (13), which delimits, on the same side, each of the plurality of water flows in the respective outlet conduits (33, 34) before said intersection (10), a fifth conduit (15) is branched out from a port (Q) emerging from said en bloc body (13), close and downstream to one (3*b*) of said outlet valves (3*b*, 4*b*), said fifth conduit (15) being fully separated from said en bloc body (13), and directs a respective water flow to a nozzle means (20) lodged into said bellows (21).

2. Clothes washing machine according to claim 1, characterized in that said plurality of outlet conduits (3, 4) are directed towards respective flat conveyers made as an en bloc, and that between said en bloc flat conveyers and said en bloc body (13) a separation trench (16) is placed, whereon said intersection (10) is located.

3. Clothes washing machine according to claim 2, characterized in that said single en bloc body (13) and said en bloc flat conveyers are made up as a fully integrated en bloc item (18), and that said separation trench (16) is an empty portion placed internally of said fully integrated en bloc item (18).

4. Clothes washing machine according to claim 1, characterized in that said fifth conduit (15) is being supplied with a respective air-gap (15S).

5. Clothes washing machine according to claim 1, characterized in that said fifth conduit (15) is fully and physically separated from said integrated en bloc item (18).

* * * * *